US007448520B2

(12) United States Patent
Kolton et al.

(10) Patent No.: US 7,448,520 B2
(45) Date of Patent: Nov. 11, 2008

(54) DISPLAY HANGER FOR SUPPORTING A BELT FROM A BELT BUCKLE

(75) Inventors: Chester Kolton, Westfield, NJ (US); Michael Norman, East Brunswick, NJ (US)

(73) Assignee: B&G Plastics, Inc., Newark, NJ (US)

( * ) Notice: Subject to any disclaimer, the term of this patent is extended or adjusted under 35 U.S.C. 154(b) by 27 days.

(21) Appl. No.: 11/588,110

(22) Filed: Oct. 26, 2006

(65) Prior Publication Data

US 2008/0110943 A1 May 15, 2008

(51) Int. Cl.
*A41D 27/22* (2006.01)

(52) U.S. Cl. ..... 223/85; 223/87

(58) Field of Classification Search ..... 223/85, 223/87, DIG. 1; 206/293, 481; 248/305, 248/301; 211/113, 60.1, 71, 73
See application file for complete search history.

(56) References Cited

U.S. PATENT DOCUMENTS 4,063,669 A * 12/1977 Smilow et al. ..... 223/87
4,453,655 A * 6/1984 Smilow et al. ..... 223/87
4,930,692 A * 6/1990 Smilow et al. ..... 223/85
5,005,741 A * 4/1991 Kolton et al. ..... 223/85
5,222,638 A * 6/1993 Kolton et al. ..... 223/87
5,421,494 A 6/1995 Kolton et al.
5,452,828 A 9/1995 Kolton et al.
5,626,268 A * 5/1997 Kolton et al. ..... 223/85
5,988,462 A * 11/1999 Kolton ..... 223/85
6,264,077 B1 7/2001 Kolton et al.
6,299,039 B1 * 10/2001 Hsu ..... 223/87
6,497,347 B1 * 12/2002 Feibelman et al. ..... 223/87

* cited by examiner

*Primary Examiner*—Gary L. Welch
*Assistant Examiner*—Andrew W Sutton
(74) *Attorney, Agent, or Firm*—Hoffmann & Baron, LLP

(57) ABSTRACT

In accordance with the present invention, the foregoing disadvantages of the prior art are addressed. In one aspect of the present invention, a hanger for supporting a belt buckle includes a flexible body having a top end, bottom end and prong portion therebetween. The top and bottom ends include top locking component and corresponding bottom locking component respectively. The locking components engage to lock the top end to the bottom end. The prong portion includes an access opening and prong holder. The prong portion limits movement of a prong within the hanger to prevent dislodgement of the prong.

14 Claims, 5 Drawing Sheets

DISPLAY HANGER FOR SUPPORTING A BELT FROM A BELT BUCKLE

CROSS-REFERENCE TO RELATED APPLICATION

This application claims priority to U.S. Provisional Patent Application No. 60/713,788, filed on Oct. 31, 2005, which is incorporated herein by reference.

FIELD OF THE INVENTION

The present invention relates generally to hangers for the display of articles and pertains more particularly to improved hangers for the display of belts of the so-called "folded tail" type.

BACKGROUND OF THE INVENTION

Belt hangers are typically adapted to support an apparel belt from the buckle end thereof in depending condition in such manner that a plurality of such devices may be selectively engaged with a horizontally supported rod whereby a plurality of belts may be displayed in a given area, and selectively removed by a purchaser.

Devices of this general type are known in the art, and usually include provision not only for the engagement of the belt buckle, but for the displaying of appropriate information, such as price, size, the name of the manufacturer and the like.

Belt hangers typically employ an upper hook portion for supporting the hanger on a display rod, a central body portion depending from the hook portion, and a lower tail portion suspended from the body portion and defining an opening. In use, the tail portion is inserted into the frame of a belt buckle and the prong of the buckle is nested in the opening. The belt is then hung from the display rod.

One disadvantage of such known hangers was that the buckle could be readily separated from the hanger. Such separation may occur innocently in the course of a customer applying the belt across his or her waist, but sometimes fraudulently in instances wherein the hanger includes pricing data and the customer desires to shift a hanger from a less expensive belt to a hanger for a more expensive belt.

It is therefore desirable to provide a belt hanger which supports a belt from the buckle thereof and which prevents the prong from being dislodged from the hanger.

SUMMARY OF THE INVENTION

In accordance with the present invention, the foregoing disadvantages of the prior art are addressed. In one aspect of the present invention, a hanger for supporting a belt buckle includes a flexible body having a top end, bottom end and prong portion therebetween. The top and bottom ends include top locking component and corresponding bottom locking component respectively. The locking components engage to lock the top end to the bottom end. The prong portion includes an access opening and prong holder. The prong portion limits movement of a prong within the hanger to prevent dislodgement of the prong.

In another aspect of the present invention, a hanger for supporting a belt buckle includes a flexible body having a top end and bottom end. The top end includes a top locking component and the bottom end includes a corresponding bottom locking component. These locking components engage to lock the top end to the bottom end. The flexible body includes an access opening and prong holder. The access opening includes a vertical slot in communication with a traverse slot. The prong portion includes a pair of upstanding projections defining a space therebetween to accommodate a prong therein.

In a further aspect of the invention, a hanger for supporting a belt buckle includes an integral body defining a hook portion for use with a display rod and an extended portion adapted to be folded on itself to form a loop. The integral body has a front planar surface, a rear planar surface and a prong access opening therethrough. The extended portion has a pair of projections spaced apart defining a prong seat space therebetween for retaining a prong from the belt buckle therein.

DESCRIPTION OF THE INVENTION

Figure 1:
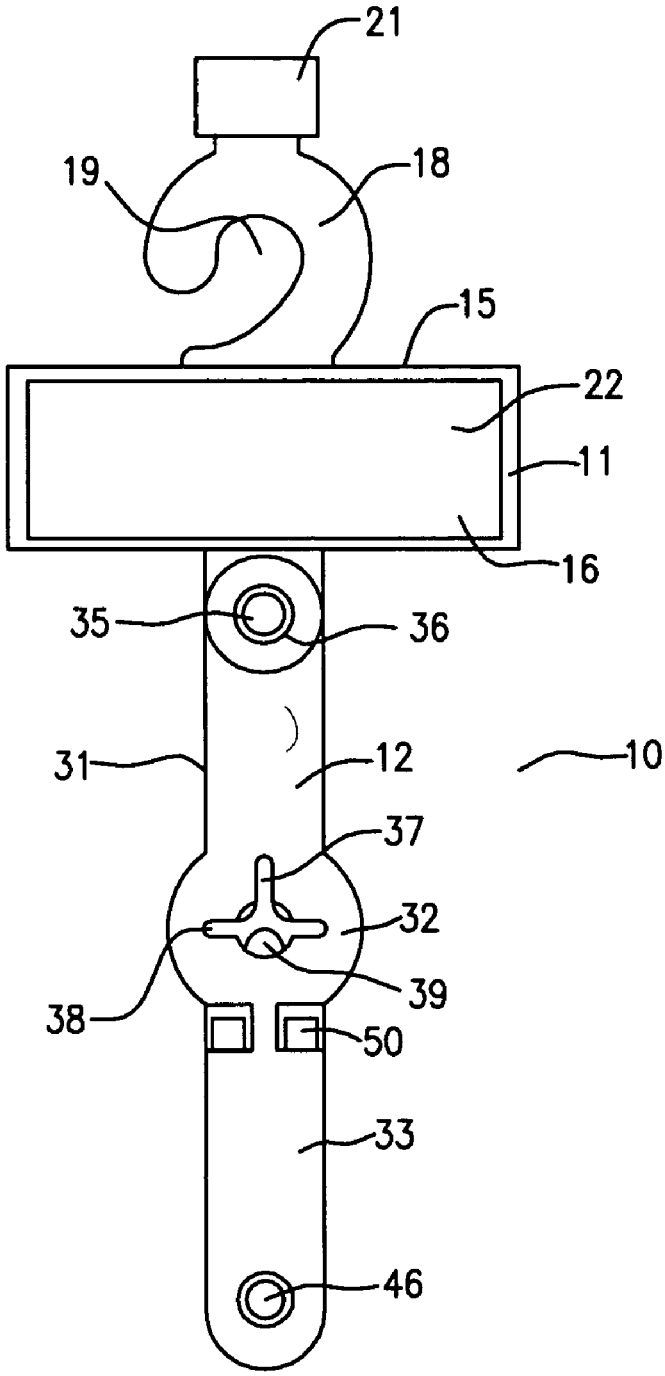
FIG. 1 is a plan view of the hanger of the present invention.
Figure 2:
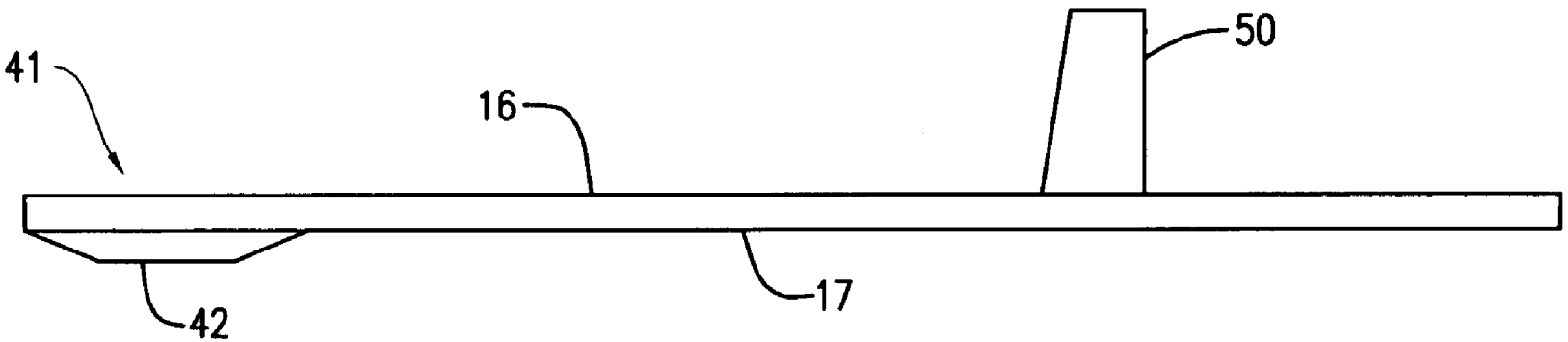
FIG. 2 is a side view of the hanger of FIG. 1.
Figure 3:
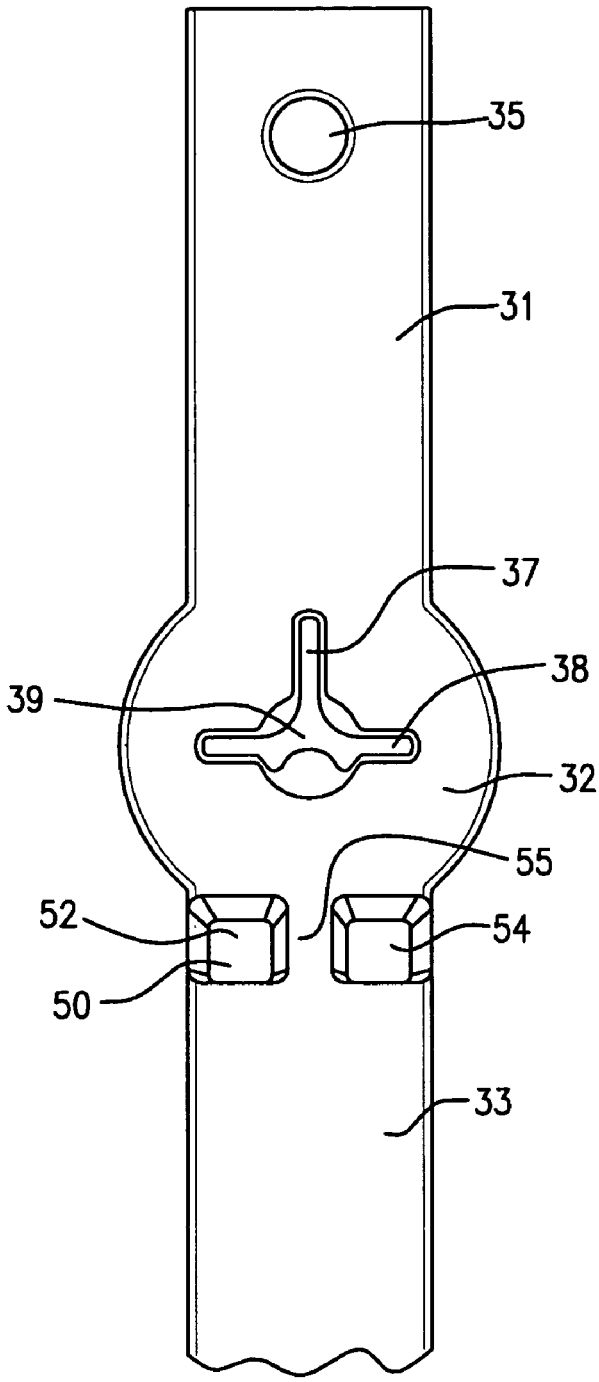
FIG. 3 is a top partial view of the hanger of FIG. 1.

The present invention includes a hanger of the type shown in commonly assigned U.S. Pat. Nos. 4,453,655; 4,930,692; 5,005,741; 5,222,638; 5,421,494; 5,452,828; 5,626,268; and 6,264,077, which are incorporated herein by reference for all purposes.

Referring to the FIGS. 1-4, hanger 10 is formed preferably as a molded plastic member and comprises a main body portion 11 and a foldable tail, or loop-forming portion 12. Body portion 11 is of generally rectangular configuration and is bounded by a continuous peripheral edge 15, as well as a front surface 16 and a rear surface 17. A hook portion 18 overlies a correspondingly shaped recess 19, permitting the hanger to be engaged upon a display rod (not shown), to be hung therefrom. Extending upwardly from hook portion 18 is an optional size-indicating tab 21. A price and logo display area 22 may be provided, as desired.

Figure 4:
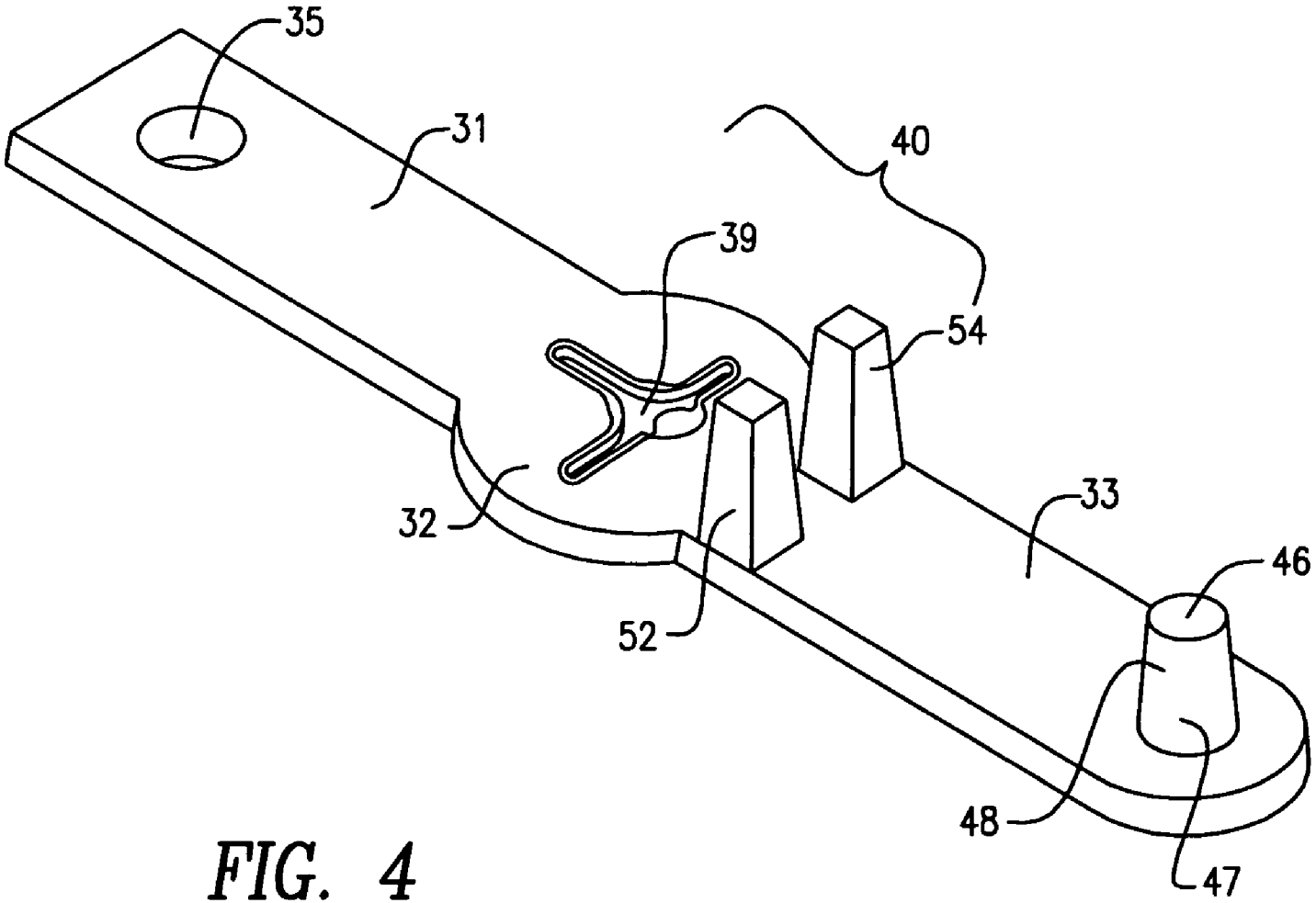
FIG. 4 is a perspective view of the tail of the hanger of FIG. 1.
Figure 5:
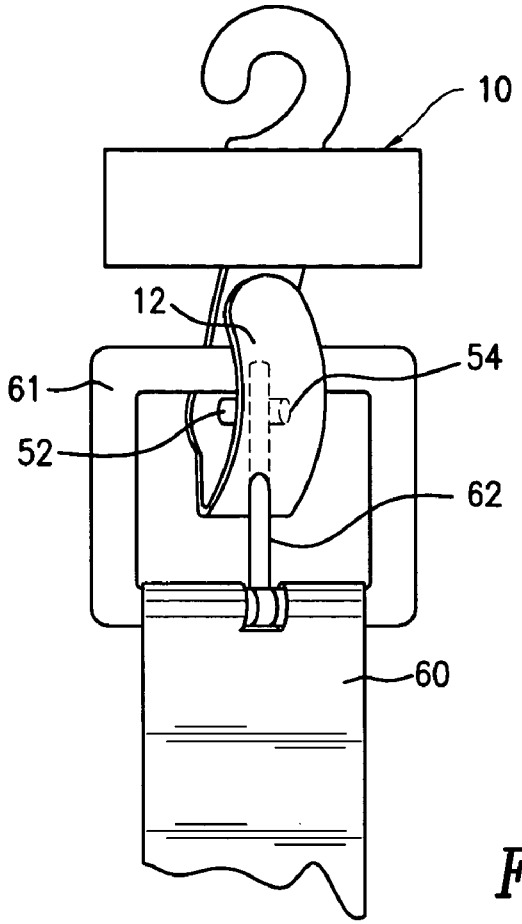
FIG. 5 is a perspective view of the hanger of FIG. 1 attached to a belt buckle.

FIGS. 4 and 5 show foldable tail portion 12 includes a top and bottom end with corresponding locking components to engage the ends and form a loop. FIGS. 1-4 show foldable tail portion includes a first elongated section 31, a bend section 32, and a second elongated section 33. The section 31 includes a top locking component 36 with a generally circular opening 35 at an upper end 36. Opening 35 is designed to receive and engage with a bottom locking component, i.e. locking projection 46. Therefore, opening 35 may vary in shape to correspond with the shape of locking projection 46. Further, section 31 may include a concavity in the top surface with opening 35 at the lowest point of the concavity to provide for retentive receipt of the locking projection. The concavity 41 creates a protruding portion 42 on the rear surface. This arrangement provides for additional support about the opening 35 for easier assembly without deformation. Additionally, the arrangement minimizes the amount of projection 46 extending beyond the rear surface 17 which deters unauthorized removal of the projection 46 from opening 35.

The lower end adjacent the bend section 32 includes an opening 39 having a vertical slot 37 communicating with a transverse slot 38 forming means for engaging the conventional center prong 62 of the belt buckle 61, with which the hanger may be selectively used.

The second elongated section 33 is of configuration generally similar to that of the first portion 31. A locking projection 46 engages the opening 35. Projection 46 has a shank 47 and a locking member 48 of diameter or dimension exceeding that of shank 47 which locks into opening 35. The engagement of projection 46 in opening 35 forms a loop around the conventional belt buckle. In this condition, the prong of the belt buckle is located in the opening 39.

As noted above, often during use or handling, the prong 62 of the belt buckle 61 may be dislodged from the opening. To prevent this, the hanger 10 of the present invention includes a prong portion 40 to engage and retain the prong 62 of belt buckle 61. The prong portion 40 includes an upstanding prong holder 50 located adjacent opening 39. Prong holder 50 includes a pair of upstanding projections 52 and 54 with a space 55 therebetween. With the tail folded about the buckle and the prong seated in opening 39, the end of the prong will be seated through the space 55 between projections 52 and 54. Such positioning secures the prong within the loop of the hanger 10 and prevents the prong from being dislodged from the opening 39 and thereby the hanger 10.

Figure 6:
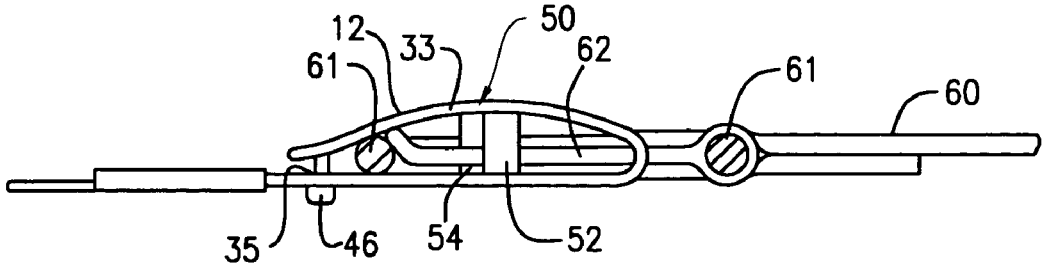
FIG. 6 is a cross-sectional side view of the FIG. 5.

FIGS. 5 and 6 show the hanger 10 engaged about a belt 60, specifically, belt buckle 61. The foldable tail portion 12 is looped about the belt buckle 61. Prong 62 extends through opening 39 and seats between projections 52 and 54 in space 55. This arrangement limits movement of the prong within the folded tail portion 12 which prevents dislodgement of the prong 62 and removal of the hanger 10.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A hanger for supporting a belt buckle comprising a flexible body having a top end, bottom end and prong portion therebetween, said top end includes a top locking component and said bottom end includes a corresponding bottom locking component, said body being foldable at a central location so that said top locking component and said bottom locking component engage to lock said top end to said bottom end, said prong portion includes an access opening for a prong to extend therethrough, a pair of upstanding projections positioned between said access opening and said bottom locking component, said pair of upstanding projections positioned a distance from said bottom locking component to provide adequate space for a buckle between said prong holder and said top locking component when said topen locking component and said bottom locking component are engaged said prong portion limiting movement of a prong and said buckle within said hanger and preventing lodgement of said prong.

2. The hanger of claim 1 wherein said access opening includes a vertical slot communicating with a traverse slot.

3. The hanger of claim 1 wherein said pair of upstanding projections includes a space therebetween to accommodate said prong therein.

4. The hanger of claim 1, wherein said pair of upstanding projections is located adjacent said access opening.

5. The hanger of claim 1 wherein said integral body has an additional portion extending rearwardly of said top locking component and defining a cavity for retentive receipt of said bottom locking component.

6. The hanger of claim 1 wherein said bottom locking component defines a locking member at an end thereof and a shank intermediate said locking member and said flexible body, said locking member having a cross-sectional dimension larger then a cross-sectional dimension of said shank.

7. The hanger of claim 6 wherein said locking member has lead-in geometry to guide said top locking component.

8. A hanger for supporting a belt buckle comprising a flexible body having a top end and bottom end, said top end includes a top locking component and said bottom end includes a corresponding bottom locking component, said top locking component and said bottom locking component being mutually engageable to lock said top end to said bottom end, said flexible body includes an access opening, said access opening includes a vertical slot in communication with a traverse slot for accommodating said prong therein, and a pair of upstanding projections positioned between said access opening and said bottom locking component, said pair of upstanding projections defining a space therebetween to accommodate a prong therein.

9. The hanger of claim 8 wherein said pair of upstanding projections is located adjacent said access opening.

10. A hanger for supporting a belt buckle comprising an integral body defining a hook portion for use with a display rod and an extended portion adapted to be folded on itself to form a loop, said integral body having a front planar surface, a rear planar surface and a prong access opening therethrough, said extended portion having a pair of projections positioned between said prong access opening and an end of said extended portion opposite said hook portion, said pair of projections spaced apart defining a prong seat space therebetween for retaining a prong from said belt buckle therein.

11. The hanger of claim 10 wherein said front planar surface includes a locking projection extending forwardly of said front planar surface and a corresponding opening through said extended portion for accepting said locking projection therethrough.

12. The hanger of claim 11 wherein said corresponding opening has an additional portion extending thereabout, said additional portion extending rearwardly of said rear planar surface and defining a cavity for retentive receipt of said locking projection, said cavity extending from said front planar surface beyond said rear planar surface.

13. The hanger of claim 12 wherein said locking projection defines a locking member at an end thereof and a shank intermediate said locking member and said extended portion, said locking member having a cross-sectional dimension larger then a cross-sectional dimension of said shank.

14. The hanger of claim 13 wherein said locking member has lead-in geometry to guide said locking member and said locking receiving opening.

* * * * *